US007426340B2

(12) United States Patent
Seo

(10) Patent No.: US 7,426,340 B2
(45) Date of Patent: Sep. 16, 2008

(54) STAGE APPARATUS AND CAMERA SHAKE CORRECTION APPARATUS USING THE STAGE APPARATUS

(75) Inventor: Shuzo Seo, Saitama (JP)

(73) Assignee: Hoya Corporation, Tokyo (JP)

( * ) Notice: Subject to any disclaimer, the term of this patent is extended or adjusted under 35 U.S.C. 154(b) by 769 days.

(21) Appl. No.: 11/070,261

(22) Filed: Mar. 3, 2005

(65) Prior Publication Data

US 2005/0204640 A1 Sep. 22, 2005

(30) Foreign Application Priority Data

Mar. 8, 2004 (JP) ..... 2004-064640

(51) Int. Cl.
*G03B 17/00* (2006.01)
*G02B 27/64* (2006.01)
*G02B 7/02* (2006.01)

(52) U.S. Cl. ..... 396/153; 359/557; 359/813; 348/208.2; 348/208.7; 348/208.11; 396/52; 396/53; 396/54; 396/55

(58) Field of Classification Search ..... 396/153; 348/208.99, 208.2, 208.4, 208.7, 208.11; 52/7

See application file for complete search history.

(56) References Cited

U.S. PATENT DOCUMENTS 5,659,806 A * 8/1997 Miyamoto et al. ..... 396/54
5,721,969 A * 2/1998 Arai ..... 396/55
6,853,506 B2 2/2005 Saitoh
2006/0033818 A1 * 2/2006 Wada et al. ..... 348/208.11

FOREIGN PATENT DOCUMENTS

JP 10-268373 10/1998
JP 11-148984 6/1999

OTHER PUBLICATIONS

English language Abstract of JP 10-268373.
English language Abstract of JP 11-148984.

* cited by examiner

*Primary Examiner*—Patrick Assouad
*Assistant Examiner*—Autumn Parker
(74) *Attorney, Agent, or Firm*—Greenblum & Bernstein, P.L.C.

(57) ABSTRACT

A stage apparatus in which a movable stage is guided in first and second directions orthogonal to each other on a stationary member, includes a pair of first elongated holes formed on one of the movable stage and the stationary member and are elongated in the first direction; a pair of link members having two engaging pins at first ends thereof which are engaged in the pair of first elongated holes to be movable therein, respectively, one of second ends of the pair of link members being pivoted at the other of the movable stage and the stationary member, and the other of the second ends of the pair of link members being supported by the other of the movable stage and the stationary member; and a link-member support mechanism for moving the movable stage in the second direction while maintaining a symmetrical shape thereof.

27 Claims, 10 Drawing Sheets

STAGE APPARATUS AND CAMERA SHAKE CORRECTION APPARATUS USING THE STAGE APPARATUS

BACKGROUND OF THE INVENTION

1. Field of the Invention

The present invention relates to a stage apparatus which moves a movable stage in two orthogonal directions in a plane, and a camera shake correction apparatus using the stage apparatus.

2. Description of the Prior Art

A known stage apparatus in which a movable stage is moved in two orthogonal directions in a plane is described in, for example, Japanese laid-open patent publications H10-268373 and H11-148984.

Each of such known stage apparatuses is provided with a stationary support plate, a movable stage, a linkage, and a driving system. The movable stage is provided parallel to the stationary support plate. The movable stage is guided by the linkage to be movable relative to the stationary support plate in two orthogonal directions: a specific Y-direction parallel to the movable stage and an X-direction orthogonal to the Y-direction. The driving system drives the movable stage in the X and Y directions.

When the movable stage is driven in the X and Y directions by the driving system, the movable stage moves relative to the stationary support plate in the X and Y directions while changing the shape of the linkage in the X and Y directions.

However, the linkage used in each of the above known stage apparatuses is constructed out of a large number of components, thus leading to a complicated structure and an increase in the production cost of the stage apparatus.

SUMMARY OF THE INVENTION

The present invention provides a simple stage apparatus which is constructed out of a relatively few number of components, and also provides a camera sake correction apparatus using such a stage apparatus.

According to an aspect of the present invention, a stage apparatus is provided, in which a movable stage is guided in first and second directions orthogonal to each other on a stationary member, the stage apparatus including a pair of first elongated holes formed on one of the movable stage and the stationary member, the pair of first elongated holes being align on a straight line extending in the first direction; a pair of link members having engaging pins at first ends thereof which are engaged in the pair of first elongated holes to be relatively movable therein along said first direction, respectively, one of second ends of the pair of link members being pivoted at the other of the movable stage and the stationary member, and the other of the second ends of the pair of link members being supported by the other of the movable stage and the stationary member; and a link-member support mechanism for moving the movable stage in the second direction by moving the pair of link members while maintaining a symmetrical shape thereof with respect to an imaginary axis which extends in the second direction.

It is desirable for central portions of the pair of link members to be pivotally mounted to each other so that the pair of link members form a shape of a letter X.

It is desirable for the link-member support mechanism to include a pivot, fixed to the stationary member, about which the one of the second ends of the pair of link members is pivoted; an angle-varying elongated hole formed on the stationary member elongated in the first direction; and a support pin fixed to the other of the second ends of the pair of link members to be slidably engaged in the angle-varying elongated hole.

It is desirable for the pair of link members to be positioned so as to not to overlap each other in a third direction orthogonal to both the first direction and the second direction.

It is desirable for the second ends of the pair of link members to be pivoted on the stationary member.

It is desirable for the second ends of the pair of link members to include two gears, respectively, which remain in mesh with each other so that the pair of link members pivot about axes of the two gears in opposite rotational directions, respectively, in a symmetrical manner with respect to the imaginary axis.

It is desirable for the second ends of the pair of link members include two frictional engaging members, respectively, which remain engaged with each other so that the pair of link members pivot about axes of the frictional engaging members in opposite rotational directions, respectively, in a symmetrical manner with respect to the imaginary axis.

It is desirable for the stage apparatus to include a second-direction actuator which moves the movable stage in the second direction relative to the stationary member while expanding and contracting the pair of link members in the second direction; and a first-direction actuator which moves the movable stage in the first direction relative to the pair of link members.

It is desirable for the pair of link members to be positioned so as to form a shape of a letter V.

It is desirable for each of the first-direction actuator and the second-direction actuator to include an electromagnetic actuator.

It is desirable for the stage apparatus to include a support device for continuously supporting and holding a plate portion of the movable stage in a position parallel to the stationary member.

It is desirable for the support device to include a plurality of springs.

It is desirable for the link-member support mechanism to include a connecting pin, the central portions of the pair of link members being pivoted about the connecting pin.

It is desirable for the imaginary axis to pass through the connecting pin.

It is desirable for the imaginary axis to pass through a pivot about which the central portions of the pair of link members are pivoted.

It is desirable for the stationary member to be formed as a stationary support plate positioned perpendicular to an optical axis of the photographing optical system.

In an embodiment, a stage apparatus is provided, in which a movable stage is guided in first and second directions orthogonal to each other on a stationary member, the stage apparatus including two pairs of first elongated holes formed on one of the movable stage and the stationary member, each pair of the two pairs of first elongated holes being aligned on a straight line extending in the first direction, wherein one pair opposes the other pair of the two pairs of first elongated holes in a third direction orthogonal to the first and second directions so as to define first opposed elongated holes and second opposed elongated holes; two pairs of link members, one pair of which is superimposed on the other pair thereof in the third direction to be parallel to each other so as to define first and second opposed link members which are opposed in the third direction, the first and second opposed link members having first and second engaging pins at first ends thereof which are engaged in corresponding the first and second opposed elongated holes to be relatively movable therein along said first direction, respectively, wherein a second end of the first opposed link members is pivoted on the other of the movable stage and the stationary member, and a second end of the second opposed link members is supported by the other of the movable stage and the stationary member; a link-member support mechanism for moving the movable stage in the second direction by moving the two pairs of link members while maintaining a symmetrical shape thereof with respect to an imaginary axis which extends in the second direction.

It is desirable for the stage apparatus to include a second-direction actuator which moves the movable stage in the second direction relative to the stationary member while expanding and contracting the two pairs of link members in the second direction; and a first-direction actuator which moves the movable stage in the first direction relative to the two pairs of link members.

It is desirable for the stage apparatus to be incorporated in a camera, wherein the camera includes an image pick-up device which is located on an image plane of a photographing optical system of the camera; a camera shake detection sensor which detects camera shake of the camera; and a controller for driving the first-direction actuator and the second-direction actuator in accordance with the camera shake detected by the camera shake detection sensor to stabilize an object image which is formed on the image pick-up device through the photographing optical system.

It is desirable for the stage apparatus to be incorporated in a camera, wherein the camera includes a correction lens fixed to the movable stage in front of an image plane of a photographing optical system of the camera to be provided on an optical axis of the photographing optical system; a camera shake detection sensor which detects camera shake of the camera; and a controller for driving the first-direction actuator and the second-direction actuator in accordance with the camera shake detected by the camera shake detection sensor to stabilize an object image which is formed on the image pick-up device through the photographing optical system and the correction lens.

It is desirable for the stationary member to be formed as a stationary support plate positioned perpendicular to an optical axis of the photographing optical system.

It is desirable for central portions of the two pairs of link members to be pivotally mounted to each other so that the two pairs of link members form a shape of a letter X.

It is desirable for the link-member support mechanism to include a pivot, fixed to the stationary member, about which the second end the first opposed link members is pivoted; an angle-varying elongated hole formed on the stationary member elongated in the first direction; and a support pin fixed to the second end of the second opposed link members to be slidably engaged in the angle-varying elongated hole.

It is desirable for the first and second opposed link members to be positioned so that the first opposed link members do not overlap the second opposed link members in the third direction, and the second opposed link members do not overlap the first opposed link members in the third direction.

It is desirable for the second ends of the first and second opposed link members to be pivoted on the stationary member.

It is desirable for the second ends of the first and second opposed link members to include two gears, respectively, which remain in mesh with each other so that the two pairs of link members pivot about axes of the two gears in opposite rotational directions, respectively, in a symmetrical manner with respect to the imaginary axis.

It is desirable for the second ends of the first and second opposed link members to include two frictional engaging members, respectively, which remain engaged with each other so that the two pairs of link members pivot about axes of the frictional engaging members in opposite rotational directions, respectively, in a symmetrical manner with respect to the imaginary axis.

According to the present invention, a simple stage apparatus which is constructed out of a relatively few number of components can be obtained. Furthermore, a camera shake correction apparatus using such a stage apparatus can be obtained.

The present disclosure relates to subject matter contained in Japanese Patent Application No. 2004-064640 (filed on Mar. 8, 2004) which is expressly incorporated herein in its entirety.

BRIEF DESCRIPTION OF THE DRAWINGS

The present invention will be discussed below in detail with reference to the accompanying drawings, in which.

DESCRIPTION OF THE PREFERRED EMBODIMENTS

A first embodiment of a camera shake correction apparatus (image stabilizer) 5 according to the present invention will be hereinafter discussed with reference to FIGS. 1 through 7. The camera shake correction apparatus 5 is incorporated in a digital camera 1 as shown in FIG. 1.

Figure 1:
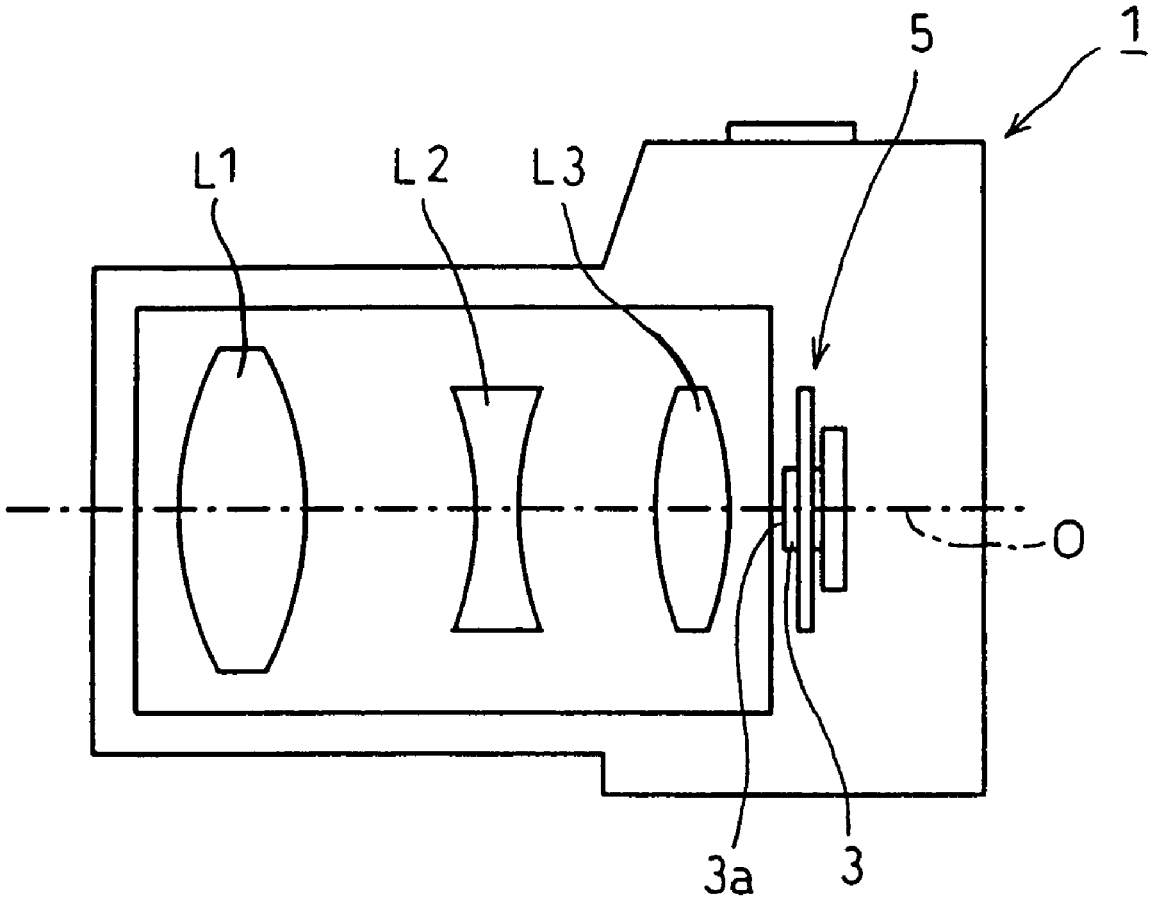
FIG. 1 is a longitudinal sectional view of a digital camera which incorporates a first embodiment of a camera shake correction apparatus according to the present invention.

As shown in FIG. 1, the digital camera 1 is provided therein with a photographing optical system including a plurality of lenses L1, L2 and L3. A CCD (image pickup device) 3 is provided behind the lens L3. The CCD 3 is provided with an image pickup surface 3*a* which is located on an image plane of the photographing optical system which is perpendicular to an optical axis O of the photographing optical system. The CCD 3 is secured to the camera shake correction apparatus 5 that is incorporated in the digital camera 1.

The camera shake correction apparatus 5 is constructed as described in the following description with reference to FIGS. 2 through 7.

Figure 2:
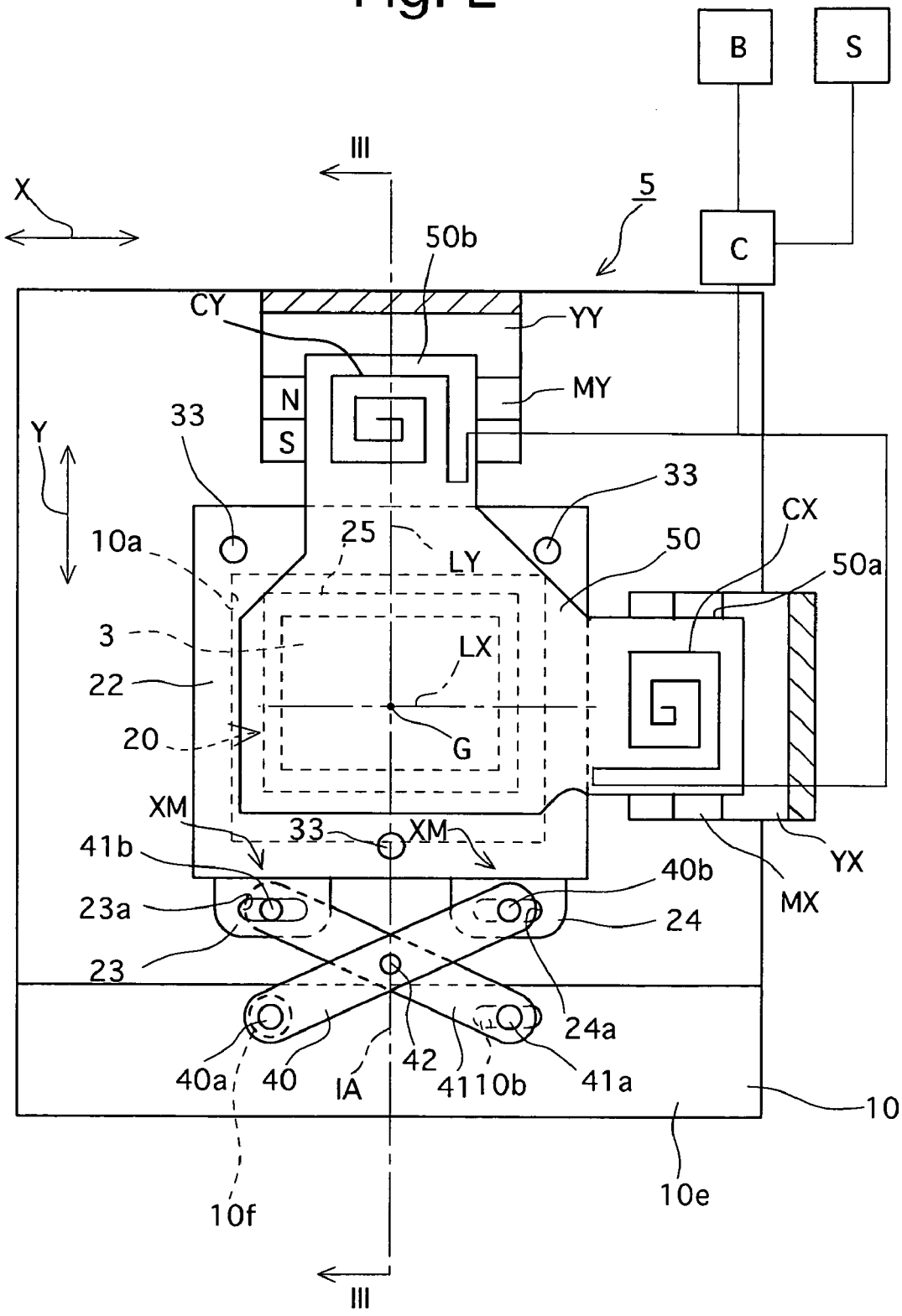
FIG. 2 is a rear elevational view of the camera shake correction apparatus shown in FIG. 1 in an inoperative state.

As shown in FIG. 2, the camera shake correction apparatus 5 is provided with a stationary support plate (stationary member) 10 which is square in shape when viewed from the rear of the camera shake correction apparatus 5. The stationary support plate 10 is provided in a central portion thereof with a square receiving hole 10*a*, and is provided at a lower end of the stationary support plate 10 with a stepped portion 10*e* which projects rearward (see FIG. 3). The stationary support plate 10 is secured to the body of the digital camera 1 by a securing device (not shown) so that the stationary support plate 10 is positioned perpendicular to the optical axis O and that the optical axis O passes through the center of the receiving hole 10*a*.

The camera shake correction apparatus 5 is provided with a cover member (an element of a movable stage) 20 which is supported by the stationary support plate 10 to be movable relative to the stationary support plate 10. The cover member 20 is provided at a central portion thereof with a bulged portion (forward-projecting portion) 21 which projects forward to be positioned in the receiving hole 10*a*, and a plate portion 22 which extends vertically and laterally from the rear end of the bulged portion 21. The bulged portion 21 is provided on a front wall thereof with a light receiving opening 21*a* having a square shape when viewed from the front of the camera shake correction apparatus 5. The plate portion 22 is provided on a bottom surface thereof with a pair of support projections (left and right support projections) 23 and 24 which extend vertically downwards. The pair of support projections 23 and 24 are provided with a left X-direction guide slot 23*a* and a right X-direction guide slot 24*a*, respectively, which are elongated in an X-direction (lateral direction of the digital camera 1 shown by a double-headed arrow X in FIG. 2; horizontal direction as viewed in FIG. 2). The left X-direction guide slot 23*a* and the right X-direction guide slot 24*a* are positioned on a straight line extending in the X-direction.

The camera shake correction apparatus 5 is provided on the cover member 20 with a base plate (an element of the movable stage) 25 which is fixed to a rear surface of the plate portion 22 of the cover member 20 so that a rear end opening 21*b* of the cover member 20 is fully covered by the plate portion 22 and so that the image pickup surface 3*a* of the CCD 3, which is fixed to the front surface of the base plate 25, is entirely exposed through the light receiving hole 21*a* as viewed from the front of the camera shake correction apparatus 5. Furthermore, a low-pass filter 26 made of a transparent material is provided in the internal space of the bulged portion 21 so that the outer edge of the low-pass filter 26 abuts against a front portion of an inner peripheral surface of the cover member 20. A retainer member 27 having a rectangular annular shape in a front elevation is sandwiched between the periphery of the image pickup surface 3*a* of the CCD 3 and the rear surface of low-pass filter 26.

Figure 3:
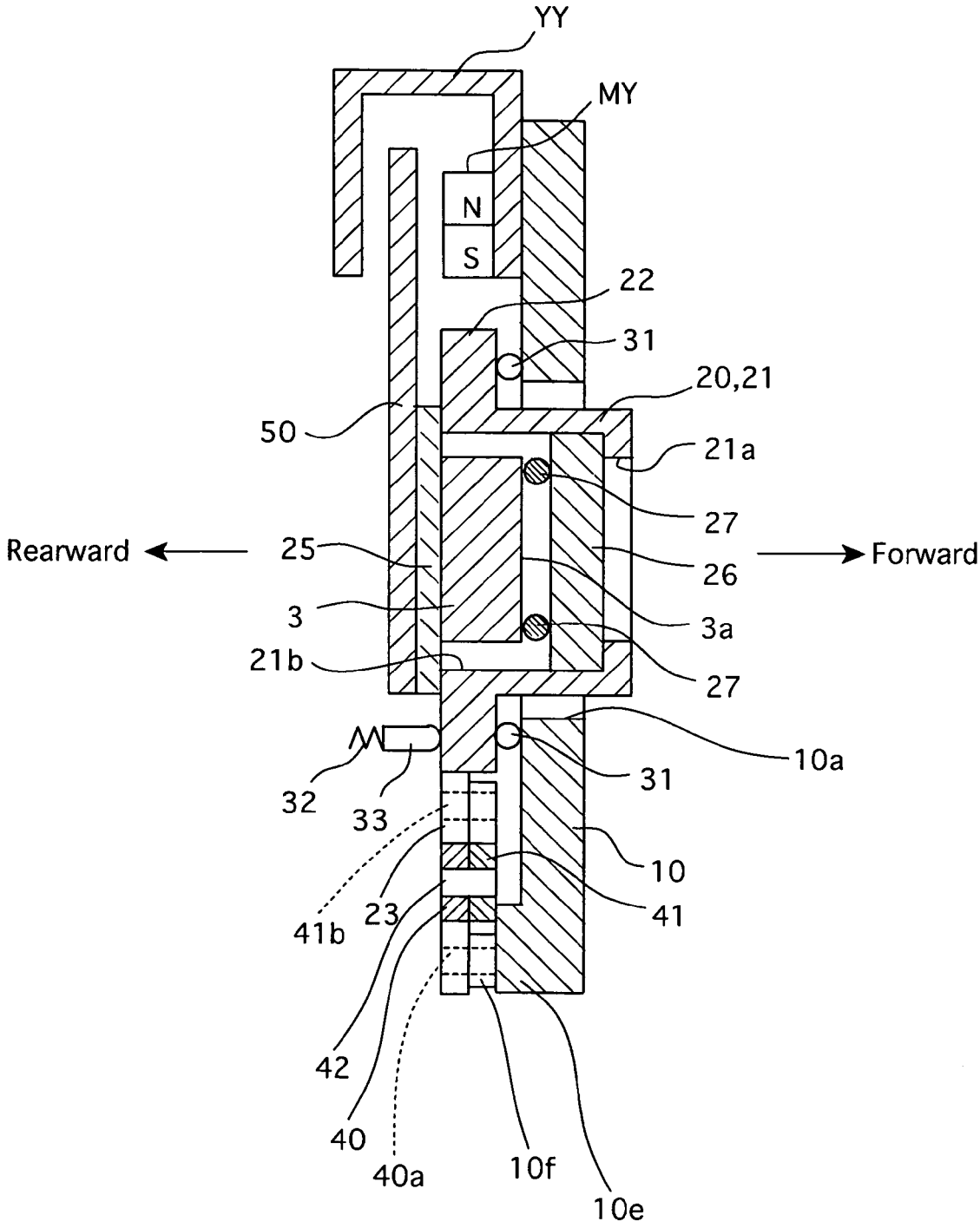
FIG. 3 is a cross sectional view taken along III-III line shown in FIG. 2.

As shown in FIG. 3, the camera shake correction apparatus 5 is provided between the stationary support plate 10 and the plate portion 22 of the cover member 20 with three rotatable balls 31 (only two of them are shown in FIG. 3). Each ball 31 is positioned on a rear surface of the stationary support plate 10 to be supported thereby to be freely rotatable at a predetermined position on the stationary support plate 10. The front surface of the plate portion 22 of the cover member 20 is in contact with the three balls 31 to be slidable thereon. The camera shake correction apparatus 5 is provided behind the plate portion 22 of the cover member 20 with three compression coil springs 32 (only one of them is shown in FIG. 3) which extend parallel to the optical axis O. The rear ends (not shown) of the three compression coil springs 32 are immovably supported inside the camera body, while three contacting members 33 (only one of them is shown in FIG. 3) are fixed to the front ends of the three compression coil springs 32, respectively. The three contacting member 33 are continuously biased forward by the three compression coil springs 32 to be pressed against the rear surface of the plate portion 22 at three different positions thereon which coincide with the positions of the three balls 31 in directions parallel to the optical axis O, respectively, to thereby press the three balls 31 against the plate portion 22 of the cover member 20.

The three balls 31, the three compression coil springs 32 and the contacting members 33 constitute a support device for continuously supporting and holding the plate portion 22 of the cover member 20 in a position parallel to the stationary support plate 10.

The camera shake correction apparatus 5 is provided with a guide mechanism via which the cover member 20 is connected to the stationary support plate 10 to be movable relative to the stationary support plate 10. This guide mechanism will be discussed hereinafter.

The camera shake correction apparatus 5 is provided below the plate portion 22 of the cover member 20 with two link members: a first link member 40 and a second link member 41 which have substantially the same shape and size. The first link member 40 and the second link member 41 overlap each other in the shape of a letter X in the optical axis direction (direction perpendicular to the sheet of paper of FIG. 2), and the overlapping central portions of the first link member 40 and the second link member 41 are pivoted about a connecting pin 42 parallel to the optical axis O so that each link member is rotatable on the connecting pin 42. The stationary support plate 10 is provided on a rear surface of the stepped portion 10*e* with a support column 10*f* which projects rearward, while one end (the lower end as viewed in FIG. 2) of the first link member 40 is pivoted about a pivot pin 40*a* which projects rearward from a rear surface of the support column 10*f* to be parallel to the optical axis O. The first link member 40 is provided, on a front surface thereof in the vicinity of the other end of the first link member 40, with an engaging pin 40*b* which projects forward to be parallel to the optical axis O so that a front portion of the engaging pin 40*b* is engaged in the X-direction guide slot 24*a* of the support projection 24 to be movable only in the X-direction relative to the cover member 20. On the other hand, the second link member 41 is provided, on a front surface thereof in the vicinity of one end (lower end as viewed in FIG. 2), with a support pin (engaging pin) 41*a* which projects forward to be parallel to the optical axis O so that a front portion of the support pin 41*a* is engaged in an angle-varying slot (recess/angle-varying elongated hole) 10*b* to be movable only in the X-direction relative to the cover member 20. The angle-varying slot 10*b* is formed on a rear surface of the stepped portion 10*e* of the stationary support plate 10 elongated in the X-direction, and is provided at the same position as the pivot pin 40*a* in a Y-direction (vertical direction of the digital camera 1 shown by a double-headed arrow Y in FIG. 2; vertical direction as viewed in FIG. 2). The other end of the second link member 41 is positioned immediately in front of the left support projection 23, and the second link member 41 is provided on a rear surface thereof in the vicinity of the other end of the first link member 40, with an engaging pin 41*b* which projects rearward to be parallel to the optical axis O so that a rear portion of the engaging pin 41*b* is engaged in the X-direction guide slot 23*a* of the support projection 23 to be movable only in the X-direction relative to the cover member 20.

The pivot pin 40*a* and the support pin 41*a* (and also the angle-varying slot 10*b*) are positioned on a straight line extending in the X-direction, while the engaging pin 40*b* and the engaging pin 41*b* are positioned on another straight line extending in the X-direction.

Since the first link member 40 and the second link member 41 have substantially the same shape and size while the central portions of the first link member 40 and the second link member 41 are pivoted about the connecting pin 42, the pivot pin 40*a* and the engaging pin 41*b* are positioned on a straight line extending in the Y-direction while the support pin 41*a* and the engaging pin 40*b* are positioned on another straight line extending in the Y-direction.

The connecting pin 42, the pivot pin 40*a*, the support pin 41*a* and the angle-varying slot 10*b* are elements of a link-member support mechanism.

The first link member 40, the second link member 41, the connecting pin 42, the pivot pin 40*a*, the support pin 41*a* and the angle-varying slot 10*b* are elements of a Y-direction guide mechanism YM.

The engaging pin 40*b* of the first link member 40, the engaging pin 41*b* of the second link member 41, the X-direction guide slot 23*a* of the support projection 23 and the X-direction guide slot 24*a* of the support projection 24 are elements of an X-direction guide mechanism XM.

The Y-direction guide mechanism YM and the X-direction guide mechanism XM constitute the guide mechanism provided in the first embodiment of the camera shake correction apparatus 5.

As shown in FIG. 2, the camera shake correction apparatus 5 is provided with an electric circuit board 50 (an element of the movable stage) which is secured to the rear surface of the base plate 25 so as not to interfere with either the compression coil springs 32 or the contacting members 33. The base plate 25, the cover member 20 and the circuit board 50 constitute a movable stage which is guided in the X and Y directions on the stationary support plate 10. The circuit board 50 is provided with a large number of conductor wires (not shown) to which the CCD 3 is electrically connected. The circuit board 50 is provided with two projecting tongues 50*a* and 50*b* on the rear surfaces of which a planar X-direction drive coil (an element of an X-direction actuator) CX and a planar Y-direction drive coil (an element of a Y-direction actuator) CY are printed, respectively. The X-direction drive coil CX and the Y-direction drive coil CY lie in a plane parallel to the circuit board 50.

Figure 4:
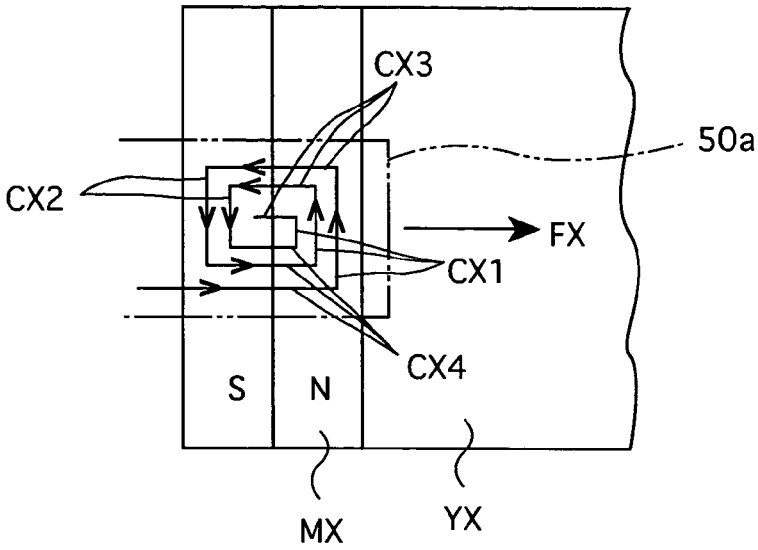
FIG. 4 is an enlarged schematic view of an X-direction driving system.
Figure 5:
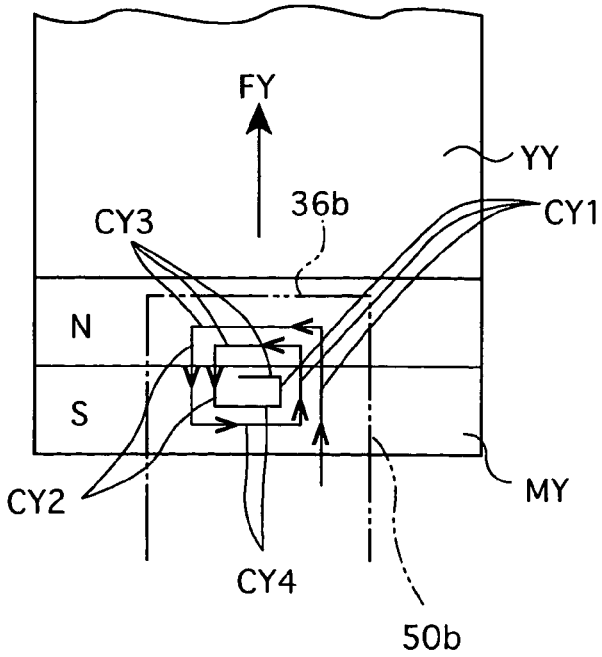
FIG. 5 is an enlarged schematic view of a Y-direction driving system.
Figure 6:
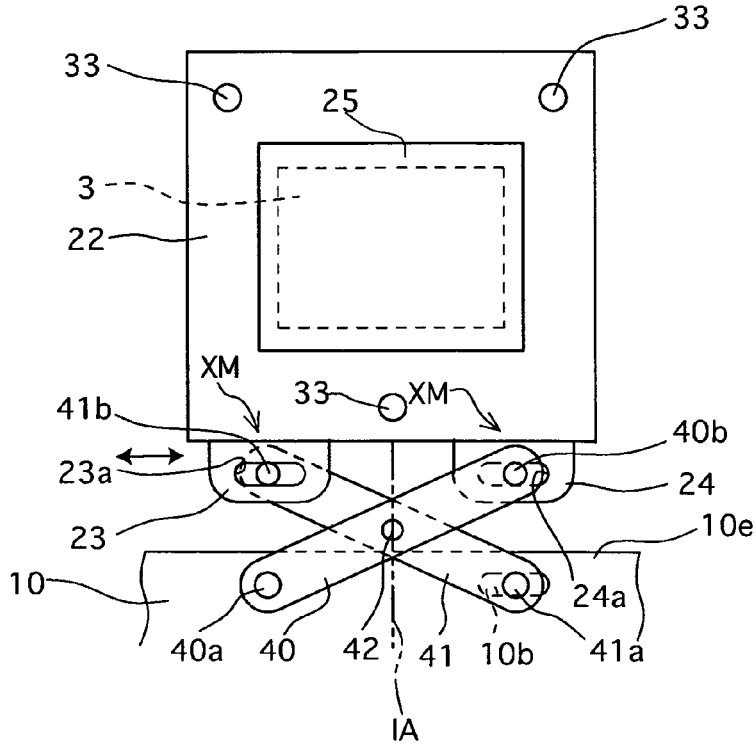
FIG. 6 is a rear elevational view of a stage apparatus shown in FIG. 2 in an inoperative state thereof, wherein an electric circuit board, two yoke members, and magnets are not shown for clarity.
Figure 7:
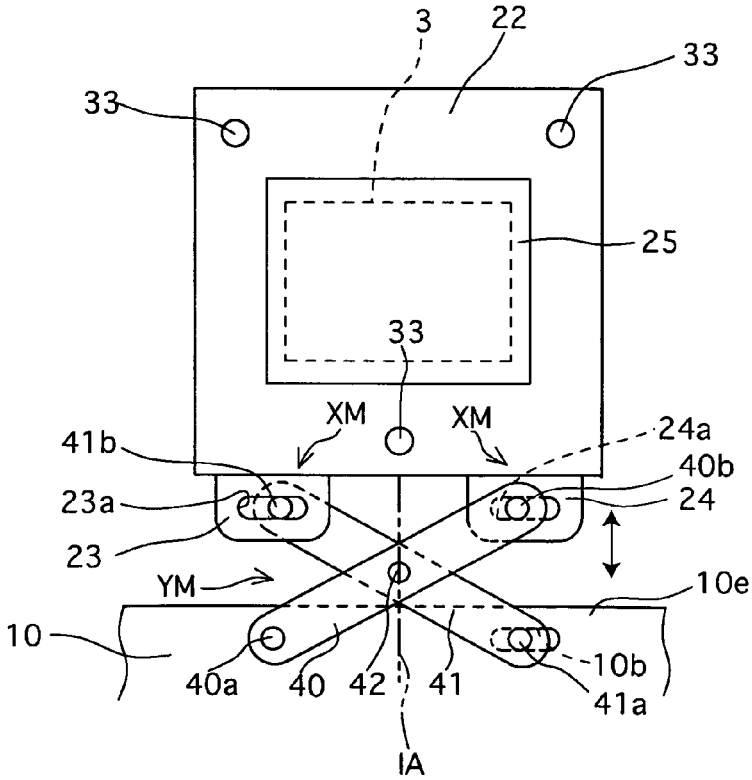
FIG. 7 is a view similar to that of FIG. 6, showing the stage apparatus in an operating state.

As shown in FIG. 4, the X-direction drive coil CX is rectangularly coiled and is defined by linear right sides CX1, linear left sides CX2, linear upper sides CX3 and linear lower sides CX4. As shown in FIG. 5, the Y-direction drive coil CY is rectangularly coiled and is defined by linear right sides CY1, linear left sides CY2, linear upper sides CY3 and linear lower sides CY4. Although the X-direction drive coil CX and the Y-direction drive coil CY have several turns in the drawings, it is desirable for there to be several scores of turns.

Each end of the X-direction drive coil CX and each end of the Y-direction drive coil CY are electrically connected to the conductor wires of the circuit board 50. Furthermore, as viewed from the rear of the camera shake correction apparatus 5, an imaginary X-direction line LX, which linearly extends in the X-direction and passes through the center of the X-direction drive coil CX, passes through the center of gravity G of a movable block consisting of the circuit board 50, the base plate 25, the CCD 3, the cover member 20, the low-pass filter 26 and the retainer member 27 as shown in FIG. 2. Likewise, as viewed from the rear of the camera shake correction apparatus 5, an imaginary Y-direction line LY, which linearly extends in the Y-direction and passes through the center of the Y-direction drive coil CY, passes through the center of gravity G of the aforementioned movable block as shown in FIG. 2.

The camera shake correction apparatus 5 is provided with two yoke members: an X-direction yoke YX (an element of the X-direction actuator) and a Y-direction yoke YY (an element of the Y-direction actuator) which are secured to the rear surface of the stationary support plate 10. The two yoke members YX and YY are made of a soft magnetic material such as metal, and are U-shaped in cross section. The two yoke members YX and YY are provided with an X-direction magnet (an element of the X-direction actuator) MX and a Y-direction magnet (an element of the Y-direction actuator) MY which are secured to inner surfaces of the two yoke members YX and YY, respectively. The magnet MX of the yoke member YX includes an N-pole and an S-pole which are aligned in the X-direction, and the magnet MY of the yoke member YY includes an N-pole and an S-pole which are aligned in the Y-direction.

As shown in FIG. 3, the rear end of the yoke member YY is opposed to the magnet MY to form a magnetic circuit, together with the magnet MY.

Likewise, the rear end of the yoke member YX forms a magnetic circuit, together with the magnet MX.

As can be seen in FIGS. 2 and 3, the projecting tongues 50*a* and 50*b* of the circuit board 50 are located in the yoke members YX and YY, respectively.

As shown in FIG. 2, the digital camera 1 is provided with a battery B, a camera shake detection sensor S for detecting camera shake of the digital camera 1, and a control circuit (control device) C which supplies the electric power of the battery B to the drive coils CX and CY while varying the direction and magnitude thereof in accordance with shake information detected by the camera shake detection sensor S. The battery B and the camera shake detection sensor S are electrically connected to the control circuit C which is electrically connected to the conductor wires of the circuit board 50.

The above described components of the camera shake correction apparatus 5 other than the battery B, the shake detection sensor S and the control circuit C constitute a stage apparatus of the camera shape correction apparatus 5.

The camera shake correction apparatus 5 operates as follows.

In a photographing operation carried out by the digital camera 1, light transmitted through the lenses L1 through L3 is converged onto the image pickup surface 3*a* of the CCD 3 through the light receiving opening 21*a* and the low-pass filter 26 to form an image on the image pickup surface 3*a*. If a camera shake correction switch (not shown) of the digital camera 1 is ON during the photographing operation, the shake detection sensor S does not detect the camera shake when no camera shake (image movement) of the digital camera 1 occurs. Consequently, the camera shake correction apparatus 5 is maintained in an inoperative position as shown in FIG. 2. If a camera shake of the digital camera 1 occurs with the camera shake correction switch ON, the shake detection sensor S detects the camera shake, and the shake information is supplied to the control circuit C. As a result, the control circuit C supplies electric current generated in the battery B to the X-direction drive coil CX and the Y-direction drive coil CY while adjusting the direction and the magnitude of the electric current.

The cover member 20 (the circuit board 50) is movable in the X-direction within a predetermined moving range, in which the linear right sides CX1 of the X-direction drive coil CX remains opposed to the N-pole of the magnet MX while the linear left sides CX2 of the X-direction drive coil CX remains opposed to the S-pole of the magnet MX in the optical axis direction, due to the engagement of the engaging pin 40*b* with the X-direction guide slot 24*a* and the engagement of the engaging pin 41*b* with the X-direction guide slot 23*a*.

In an inoperative state of the camera shake correction apparatus 5, if the electric current is supplied to the X-direction drive coil CX in the direction indicated by the arrows in FIG. 4, a rightward linear force FX in the X-direction is produced in the linear right sides CX1 and the linear left sides CX2 as shown in FIG. 4. Since the X-direction guide slots 23*a* and 24*a* of the cover member 20 that is integral with the circuit board 50 are engaged with the engaging pins 41*b* and 40*b* of the two link members 41 and 40 to be movable rightward in the X-direction relative to the engaging pins 41*b* and 40*b*, respectively, the rightward linear force FX causes the cover member 20 to move rightward relative to the stationary support plate 10. Note that forces are produced in the linear upper sides CX3 and the linear lower sides CX4 during such a rightward movement of the cover member 20; however, these forces cancel each other out and are not applied to the circuit board 50.

When electric current in a direction opposite to the arrows shown in FIG. 4 is supplied to the X-direction drive coil CX, linear forces toward the left in the X-direction are produced in the linear right sides CX1 and the linear left sides CX2, the cover member 20 moves leftward relative to the stationary support plate 10 due to the engagement of the engaging pin 40*b* with the X-direction guide slot 24*a* and the engagement of the engaging pin 41*b* with the X-direction guide slot 23*a*. By adjusting the direction of the electric current supplied to the X-direction drive coil CX by the control circuit C in the above described manner, the circuit board 50 moves in the X-direction (lateral direction) within the aforementioned predetermined moving range, in which the linear right sides CX1 of the X-direction drive coil CX remains opposed to the N-pole of the magnet MX while the linear left sides CX2 of the X-direction drive coil CX remains opposed to the S-pole of the magnet MX in the optical axis direction.

Moreover, as soon as the supply of the current from the battery B to the X-direction drive coil CX is stopped, the movement of the circuit board 50 is stopped due to absence of the force in the X-direction.

Since the magnitude of the current to be supplied to the X-direction drive coil CX is proportional to the magnitude of the force in the X-direction which is produced by the current supplied to the X-direction drive coil CX, the force FX that is applied to the X-direction drive coil CX is increased or reduced by increasing or reducing the current supplied to the X-direction drive coil CX from the battery B.

On the other hand, the cover member 20 (the circuit board 50) is movable in the Y-direction within a predetermined moving range, in which the linear upper sides CY3 of the Y-direction drive coil CY remains opposed to the N-pole of the magnet MY while the linear lower sides CY4 of the Y-direction drive coil CY remains opposed to the S-pole of the magnet MY in the optical axis direction, due to the engagement of the support pin 41*a* with the angle-varying slot 10*b*.

In an inoperative state of the camera shake correction apparatus 5, if the electric current is supplied to the Y-direction drive coil CY in the direction indicated by the arrows in FIG. 5, the upward linear force FY in the Y-direction is produced in the linear upper sides CY3 and the linear lower sides CY4 as shown in FIG. 5. The upward linear force FY causes the Y-direction guide mechanism YM to change the shape thereof so that the support pin 41*a* linearly moves leftward in the angle-varying slot 10*b* and so that the engaging pins 41*b* and 40*b* linearly move in directions approaching each other in the X-direction guide slots 23*a* and 24*a*, respectively (see FIG. 7). As a result, the distance between the pivot pin 40*a* and the engaging pin 41*b* and the distance between the support pin 41*a* and the engaging pin 40*b* become greater than before the change in shape of the Y-direction guide mechanism YM, so that the circuit board 50 moves upward relative to the stationary support plate 10. Note that forces are produced in the linear right sides CY1 and the linear left sides CY2 during such an upward movement of the cover member 20; however, these forces cancel each other out and are not applied to the circuit board 50.

When electric current in a direction opposite to the arrows shown in FIG. 5 is supplied to the Y-direction drive coil CY, linear forces downward in the Y-direction are produced in the linear upper sides CY3 and the linear lower sides CY4, the cover member 20 moves downward relative to the stationary support plate 10 due to the engagement of the support pin 41*a* with the angle-varying slot 10*b*.

By adjusting the direction of the electric current supplied to the Y-direction drive coil CY by the control circuit C in the above described manner, the circuit board 50 moves in the Y-direction (vertical direction) within the aforementioned predetermined moving range, in which the linear upper sides CY3 of the Y-direction drive coil CY remains opposed to the N-pole of the magnet MY while the linear lower sides CY4 of the Y-direction drive coil CY remains opposed to the S-pole of the magnet MY in the optical axis direction.

Moreover, as soon as the supply of the current from the battery B to the Y-direction drive coil CY is stopped, the movement of the circuit board 50 is stopped due to absence of the force in the Y-direction.

Since the magnitude of the current to be supplied to the Y-direction drive coil CY is proportional to the magnitude of the force in the Y-direction which is produced by the current supplied to the Y-direction drive coil CY, the force FY that is applied to the Y-direction drive coil CY is increased or reduced by increasing or reducing the current supplied to the Y-direction drive coil CY from the battery B.

Accordingly, camera shake can be corrected by varying the position of the CCD 3 secured to the base plate 25 in the X and Y directions in accordance with the movement of the circuit board 50 in the X and Y directions.

Note that the two link members 40 and 41, which guide the circuit board 50 in the X and Y direction, are driven while maintaining a symmetrical shape with respect to an imaginary axis IA (see FIG. 2) which extends in the Y-direction to pass through the connecting pin 42.

In the stage apparatus discussed above, the X-direction guide mechanism XM and the Y-direction guide mechanism YM, which constitute the guide mechanism provided in the first embodiment of the camera shake correction apparatus 5, are constructed out of a less number of elements: the two link members 40 and 41, the connecting pin 42 which connects the two link members 40 and 41, and the following components for connecting each of the two link members 40 and 41 to the stationary support plate 10 and the cover member 20: the pivot pin 40*a*, the support pin 41*a*, the angle-varying slot 10*b*, the engaging pin 40*b*, the engaging pin 41*b* and the X-direction guide slots 23*a* and 24*a*. Consequently, the stage apparatus is very simple in structure, and the manufacturing cost of the camera shake correction apparatus 5 can be reduced.

Moreover, the force produced in the X-direction drive coil CX and the Y-direction drive coil CY are effectively transmitted to the circuit board 50 because the imaginary X-direction line LX passes through the center of gravity G of the movable block that consists of the circuit board 50, the base plate 25, the CCD 3, the cover member 20, the low-pass filter 26 and the retainer member 27 as viewed from the rear of the camera shake correction apparatus 5 while the imaginary Y-direction line LY passes through the center of gravity G of the same movable block as viewed from the rear of the camera shake correction apparatus 5. Therefore, the circuit board 50 can be smoothly moved in the X and Y directions.

Figure 8:
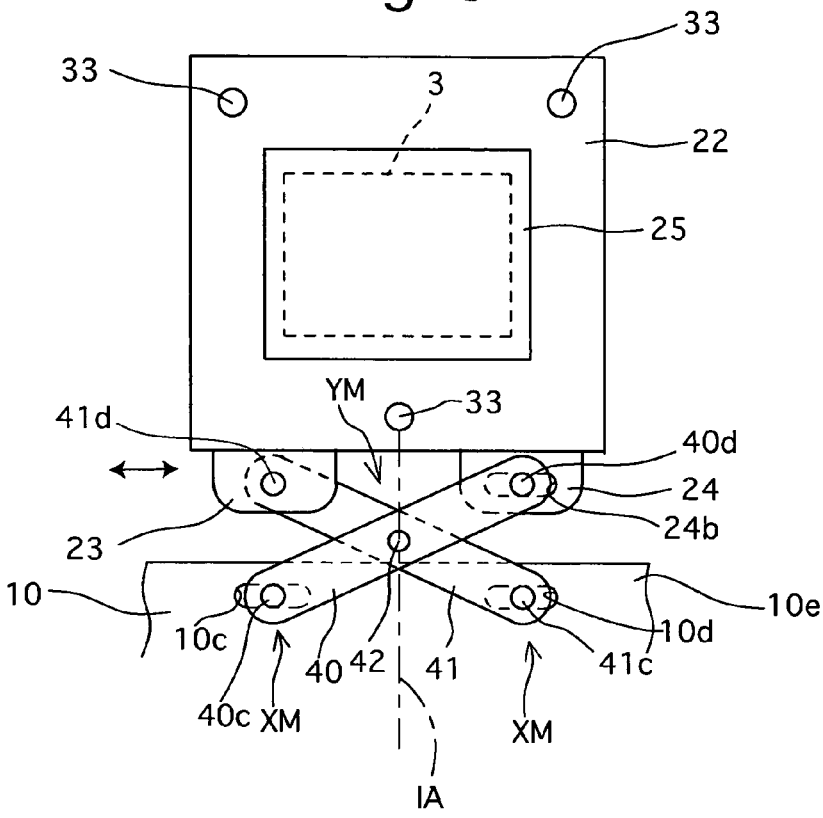
FIG. 8 is a view similar to that of FIG. 6 and illustrates a modified embodiment of a guide mechanism provided in the first embodiment of the camera shake correction apparatus, wherein the electric circuit board and other members are not shown for clarity.

FIG. 8 shows a modified embodiment of the guide mechanism provided in the first embodiment of the camera shake correction apparatus 5. In this modified embodiment shown in FIG. 8, the stationary support plate 10 is provided with a left X-direction guide slot 10*c* and a right X-direction guide slot 10*d* which are elongated in the X-direction on a straight line extending in the X-direction, the two link members (opposed link members) 40 and 41 are provided, on front surfaces thereof in the vicinity of the lower ends of the two link members 40 and 41, with two engaging pins 40*c* and 41*c* which project forward to be engaged in the left X-direction guide slot 10*c* and the right X-direction guide slot 10*d*, respectively, the upper end of the second link member 41 which is positioned immediately in front of the left support projection 23 is pivoted to the left support projection 23, and the first link member 40 is provided, on a front surface thereof in the vicinity of the upper end of the first link member 40, with a support pin 40*d* which projects forward to be engaged in an angle-varying slot 24*b* which is formed on a rear surface of the right support projection 24 elongated in the X-direction.

In this case, the pivot pin 41*d* and the engaging pin 40*d* (and the angle-varying slot 24*b*) are positioned on a straight line extending in the X-direction, while the engaging 40*c* and the engaging pin 41*c* are positioned on another straight line extending in the X-direction.

Moreover, the pivot pin 41*d* and the engaging pin 40*c* are positioned on a straight line extending in the Y-direction, while the support pin 40*d* and the engaging pin 41*c* are positioned on another straight line extending in the Y-direction.

In the modified embodiment of the guide mechanism shown in FIG. 8, the connecting pin 42, the pivot pin 41*d*, the support pin 40*d* and the angle-varying slot 24*b* are elements of a link-member support mechanism.

The first link member 40, the second link member 41, the connecting pin 42, the pivot pin 41*d*, the support pin 40*d* and the angle-varying slot 24*b* are elements of a Y-direction guide mechanism YM.

The engaging pin 40*c* of the first link member 40, the engaging pin 41*c* of the second link member 41, the X-direction guide slots 10*c* and 10*d* of the stationary support plate 10 are elements of an X-direction guide mechanism XM.

In each of the above described two guide mechanisms, the two link members 40 and 41 are driven while maintaining a symmetrical shape thereof with respect to the imaginary axis IA within a predetermined moving range in which the linear right sides CX1 of the X-direction drive coil CX remains opposed to the N-pole of the magnet MX while the linear left sides CX2 of the X-direction drive coil CX remains opposed to the S-pole of the magnet MX in the optical axis direction, and in which the linear upper sides CY3 of the Y-direction drive coil CY remains opposed to the N-pole of the magnet MY while the linear lower sides CY4 of the Y-direction drive coil CY remains opposed to the S-pole of the magnet MY in the optical axis direction, and accordingly the above described two guide mechanisms produce the same effect.

In each of the guide mechanism provided in the first embodiment of the camera shake correction apparatus 5 and the modified embodiment of the guide mechanism shown in FIG. 8, the rotatable balls 31, the three compression coil springs 32 and the three contacting members 33, which serve as a support device for supporting the cover member 20 on the stationary support plate 10, can be omitted if the support projections 23 and 24, the link members 40 and 41, the pivot pins 40*a* and 41*d*, the support pins 41*a* and 40*d*, the engaging pins 40*b*, 40*c*, 41*b* and 41*c* and the connecting pin 42 are made of material having a high strength.

Figure 9:
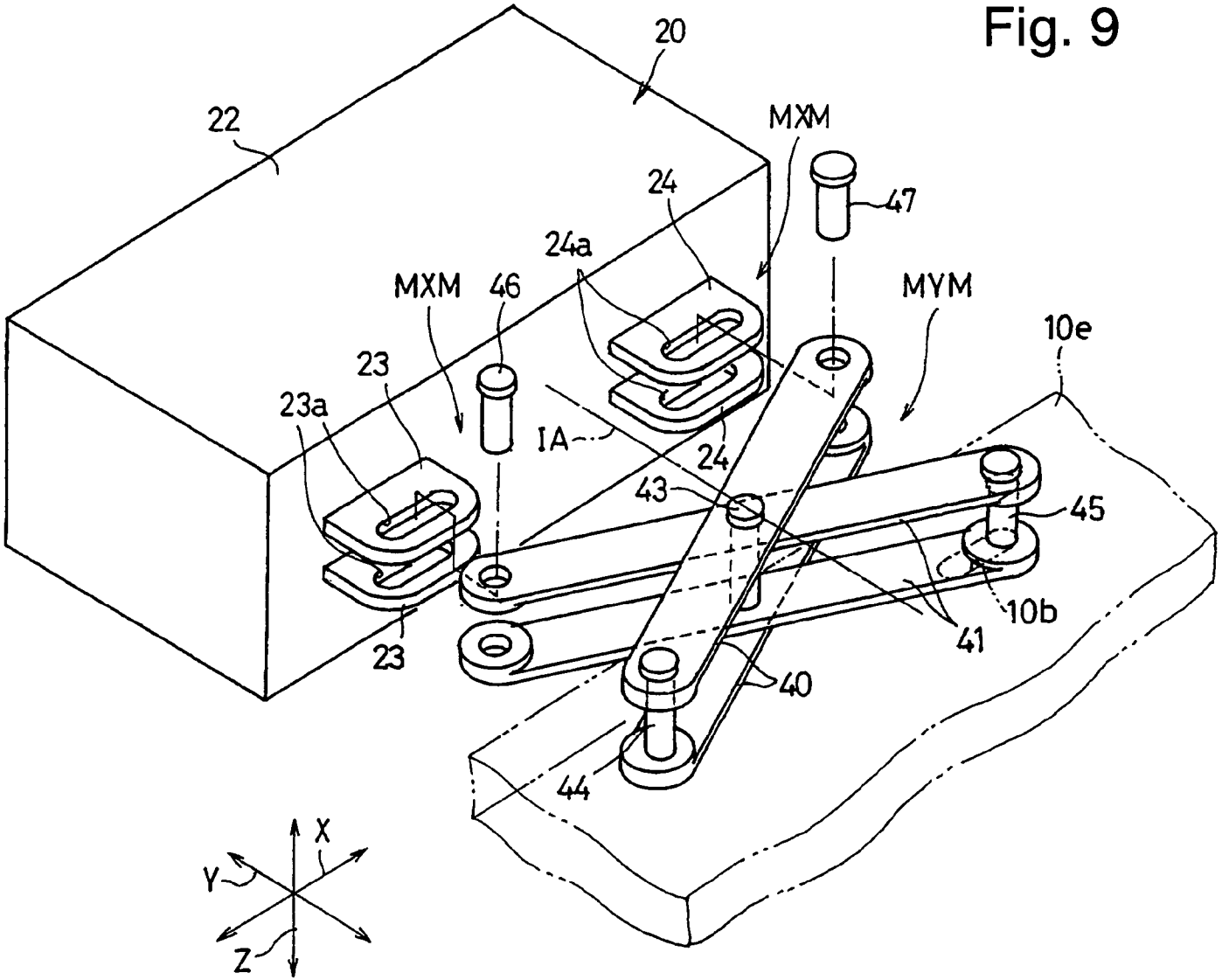
FIG. 9 is a perspective view of another modified embodiment of the guide mechanism provided in the first embodiment of the camera shake correction apparatus, wherein an electric circuit board and other members are not shown for clarity.

FIG. 9 is a perspective view of another modified embodiment of the guide mechanism provided in the first embodiment of the camera shake correction apparatus. This modified embodiment of the guide mechanism is provided with a double-layer guide mechanism consisting of an X-direction guide mechanism MXM and a Y-direction guide mechanism MYM which correspond to the above described X-guide mechanism XM and the above described Y-direction guide mechanism YM respectively. The double-layer Y-direction guide mechanism MYM is provided with two sets of the two link members 40 and 41 one set of which is superposed on the other set in the optical axis direction. Specifically, as shown in FIG. 9, the two sets of the two link members 40 and 41 are positioned so that one set of which is superposed on the other set in a Z-direction (fore-aft direction of the digital camera 1 shown by a double-headed arrow Z in FIG. 9; vertical direction as viewed in FIG. 9) orthogonal to both the X-direction and the Y-direction. The overlapping central portions of the two sets of the two link members 40 and 41 are pivoted about a connecting pin 43 parallel to the optical axis O so that each link member is rotatable on the connecting pin 43. In this case, the lower ends of the two first link members 40 are positioned immediately behind the stepped portion 10*e* of the stationary support plate 10 and pivoted about a pivot pin (connecting member) 44 which projects rearward from the rear surface of the stepped portion 10*e* of the stationary support plate 10 in the Z-direction, while a front end portion of a support pin (connecting member) 45 which connects the lower ends of the two second link members 41 is engaged in an angle-varying slot (recess) 10*b* which is formed on the rear surface of the stepped portion 10*e* elongated in the X-direction to allow the support pin 45 to move only in the X-direction. In addition, the plate portion 22 is provided on a bottom surface thereof with two pairs of support projections (two left support projections and two right support projections) 23 and 24 which extend vertically downwards, two X-direction guide slots 23*a* and two X-direction guide slots 24*a* are formed on the two left support projections 23 and the two right support projections 24, respectively, an engaging pin (connecting member) 46 which connects the upper ends of the two second link members 41 is inserted into the two X-direction guide slots 23*a* to extend in a direction parallel to the optical axis O, and an engaging pin (connecting member) 47 which connects the upper ends of the two first link members 40 is inserted into the two X-direction guide slots 24*a* to extend in a direction parallel to the optical axis O.

The connecting pin 43, the pivot pin 44, the support pin 45 and the angle-varying slot 10*b* are elements of a link-member support mechanism.

The two first link members 40, the two second link members 41, the connecting pin 43, the pivot pin 44, the support pin 45 and the angle-varying slot 10*b* are elements of the double-layer Y-direction guide mechanism MYM.

The engaging pins 46 and 47, the two X-direction guide slots 23*a* and the two X-direction guide slots 24*a* are elements of the double-layer X-direction guide mechanism MXM.

Similar to the guide mechanism provided in the first embodiment of the camera shake correction apparatus, in the guide mechanism shown in FIG. 9, the two sets of link members 40 and 41 are driven while maintaining the symmetrical shape thereof with respect to an imaginary axis IA (which extends in the Y-direction to pass through the axis of the connecting pin 43) within a predetermined moving range in which the linear right sides CX1 of the X-direction drive coil CX remains opposed to the N-pole of the magnet MX while the linear left sides CX2 of the X-direction drive coil CX remains opposed to the S-pole of the magnet MX in the optical axis direction, and in which the linear upper sides CY3 of the Y-direction drive coil CY remains opposed to the N-pole of the magnet MY while the linear lower sides CY4 of the Y-direction drive coil CY remains opposed to the S-pole of the magnet MY in the optical axis direction, and accordingly the guide mechanism shown in FIG. 9 produces the same effect as the guide mechanism provided in the first embodiment of the camera shake correction apparatus. Moreover, the strength of each of the double-layer Y-direction guide mechanism MYM and the double-layer X-direction guide mechanism MXM is increased by the above described structure of the guide mechanism in which one of the two sets of the two link members 40 and 41 is superposed on the other set of the two link members 40 and 41 in the Z-direction. Consequently, the rotatable balls 31, the three compression coil springs 32 and the three contacting members 33, which serve as a support device for supporting the cover member 20 on the stationary support plate 10, can be omitted.

It is possible for the two X-direction guide slots 23*a* and the two X-direction guide slots 24*a* to be formed on the upper ends of the two link members 41 and the upper ends of the two link members 40, respectively, and for the engaging pins 46 and 47 which are respectively engaged in the two X-direction guide slots 23*a* and the two X-direction guide slots 24*a* to be provided on the cover member 20.

It is possible for the double-layer guide mechanism to be replaced by a multi-layer guide mechanism which is provided with more than two sets of the two link members 40 and 41 which are superposed on one another in the Z-direction.

Figure 10:
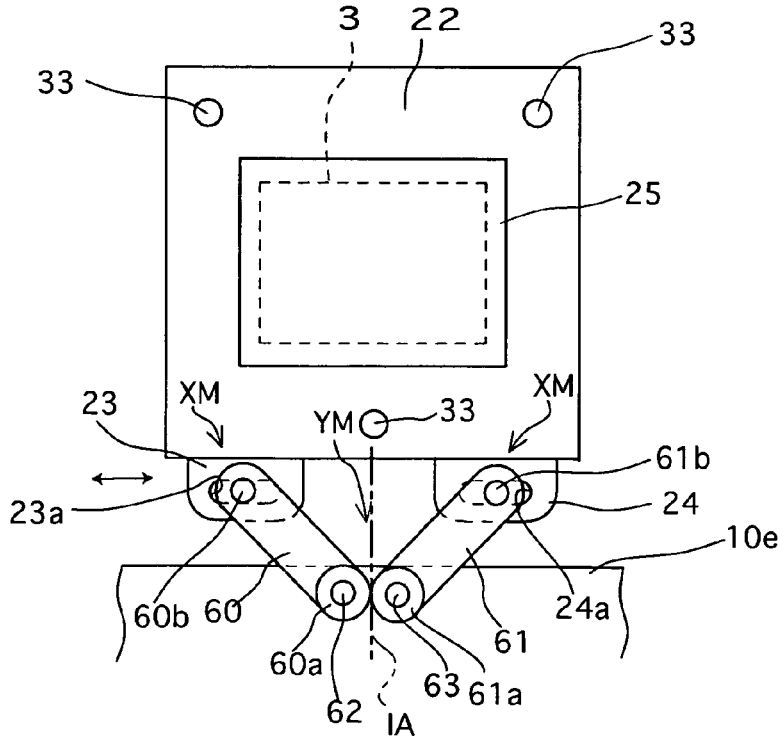
FIG. 10 is a rear elevational view of the stage apparatus provided in a second embodiment of the camera shake correction apparatus, showing the stage apparatus in an inoperative state, wherein the electric circuit board and other members are not shown for clarity.
Figure 11:
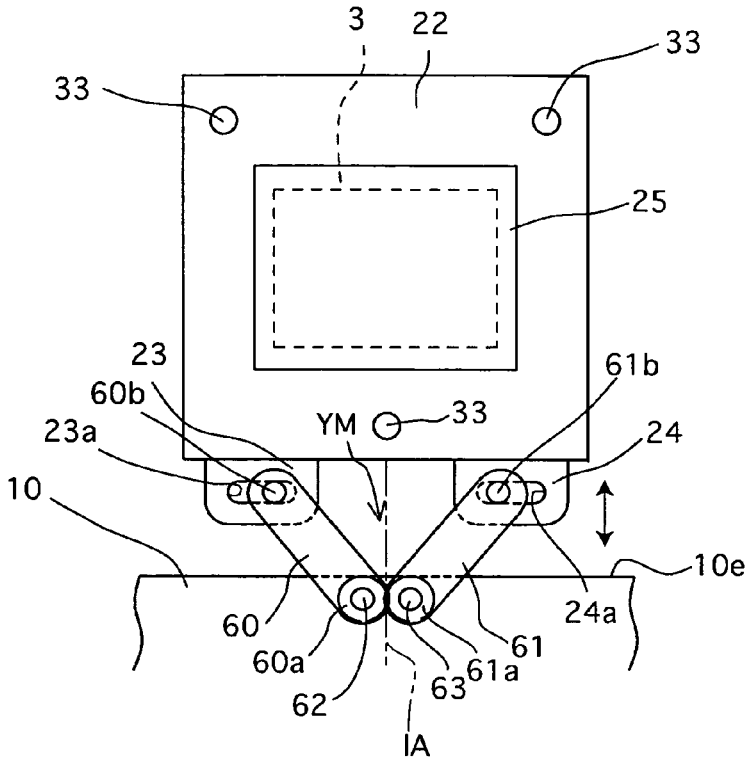
FIG. 11 is a view similar to that of FIG. 10, showing the stage apparatus in an operating state.

The stage apparatus of a second embodiment of the camera shake correction apparatus will be hereinafter discussed with reference to FIGS. 10 and 11. The difference between this stage apparatus and the stage apparatus of the first embodiment of the camera shake correction apparatus is in the structure of the guide mechanism. Namely, this stage apparatus shown in FIGS. 10 and 11 is the same the stage apparatus of the first embodiment of the camera shake correction apparatus except for the structure of the guide mechanism. Accordingly, in the stage apparatus shown in FIGS. 10 and 11, elements other than the elements of the guide mechanism which are similar to those of the stage apparatus of the first embodiment of the camera shake correction apparatus 5 are designated by the same reference numerals, and are not discussed in the following description for the sake of simplicity.

The embodiment of the guide mechanism shown in FIGS. 10 and 11 is provided below the plate portion 22 of the cover member 20 with two link members: a first link member 60 and a second link member 61 which have substantially the same shape and size. In this embodiment of the guide mechanism, the first link member 60 and the second link member 61 do not overlap each other in the optical axis direction, i.e., in a direction perpendicular to both the X-direction and the Y-direction. The two link members (opposed link members) 60 and 61 are provided at lower ends of the rear surfaces thereof with two spur gears 60*a* and 61*a*, respectively, which remain in mesh with each other. The lower end of the first link member 60 is pivoted, together with the spur gear 60*a*, about a pivot pin 62 which extends in the optical axis direction, while the lower end of the second link member 61 is pivoted, together with the spur gear 61*a*, about a pivot pin 63 which extends in the optical axis direction. The first link member 60 is provided, on a front surface thereof in the vicinity of the upper end of the first link member 60, with an engaging pin 60*b* which projects forward so that a front portion of the engaging pin 60*b* is engaged in the X-direction guide slot 23*a* of the support projection 23 to be movable only in the X-direction relative to the support projection 23. The second link member 61 is provided, on a front surface thereof in the vicinity of the upper end of the second link member 61, with an engaging pin 61*b* which projects forward so that a front portion of the engaging pin 61*b* is engaged in the X-direction guide slot 24*a* of the support projection 24 to be movable only in the X-direction relative to the support projection 24. The two spur gears 60*a* and 61*a* are in mesh with each other so that the two link members 60 and 61 are driven while maintaining the symmetrical shape thereof with respect to an imaginary axis IA which extends in the Y-direction between the pivot pins 62 and 63.

The pivot pins 62 and 63 are pivoted on the stepped portion 10*e* of the stationary support plate 10 to be positioned on a straight line extending parallel to the X-direction. The engaging pins 60*b* and 61*b* are fixed to the two link members 60 and 61 to be positioned on another straight line extending parallel to the X-direction.

The pivot pins 62 and 63 and the spur gears 60*a* and 61*a* are elements of a link-member support mechanism.

The two link members 60 and 61, the two pivot pins 62 and 63, the two spur gears 60*a* and 61*a*, the two-X-direction guide slots 23*a* and 24*a* and the two engaging pins 60*b* and 61*b* are elements of a Y-direction guide mechanism YM. The two-X-direction guide slots 23*a* and 24*a* and the two engaging pins 60*b* and 61*b* are elements of an X-direction guide mechanism XM.

The guide mechanism shown in FIGS. 10 and 11 operates as follows.

The cover member 20 (the circuit board 50) is movable in the X-direction within a predetermined moving range, in which the linear right sides CX1 of the X-direction drive coil CX remains opposed to the N-pole of the magnet MX while the linear left sides CX2 of the X-direction drive coil CX remains opposed to the S-pole of the magnet MX in the optical axis direction, due to the engagement of the engaging pins 60*b* and 61*b* with the X-direction guide slots 23*a* and 24*a*, respectively.

If the electric current is supplied to the X-direction drive coil CX to move the X-direction drive coil CX rightward in the X-direction in an inoperative state shown in FIG. 10, the cover member 20 that is integral with the circuit board 50 moves rightward due to the engagement of the engaging pins 60*b* and 61*b* with the X-direction guide slots 23*a* and 24*a*, respectively. Conversely, if the electric current is supplied to the X-direction drive coil CX to move the X-direction drive coil CX leftward in the X-direction in an inoperative state shown in FIG. 10, the cover member 20 that is integral with the circuit board 50 moves leftward due to the engagement of the engaging pins 60*b* and 61*b* with the X-direction guide slots 23*a* and 24*a*, respectively.

The cover member 20 (the circuit board 50) is movable in the Y-direction within a predetermined moving range, in which the linear upper sides CY3 of the Y-direction drive coil CY remains opposed to the N-pole of the magnet MY while the linear lower sides CY4 of the Y-direction drive coil CY remains opposed to the S-pole of the magnet MY in the optical axis direction, due to the engagement of the engaging pins 60*b* and 61*b* with the X-direction guide slots 23*a* and 24*a*, respectively.

If the electric current is supplied to the Y-direction drive coil CY to move the Y-direction drive coil CY upward in the Y-direction in an inoperative state shown in FIG. 10, the two engaging pins 60*b* and 61*b* respectively move in the X-direction guide slots 23*a* and 24*a* in directions approaching each other to decrease the interior angle between the two link members 60 and 61. As a result, the distance in the Y-direction between the pivot pin 60*a* and the engaging pin 60*b* and the distance in the Y-direction between the pivot pin 61*a* and the engaging pin 61*b* become greater than before the change in shape of the Y-direction guide mechanism YM, so that the cover member 20 together with the circuit board 50 linearly moves upward relative to the stationary support plate 10.

On the other hand, if the electric current is supplied to the Y-direction drive coil CY to move the Y-direction drive coil CY downward in the Y-direction in an inoperative state shown in FIG. 10, the two engaging pins 60*b* and 61*b* respectively move in the X-direction guide slots 23*a* and 24*a* in directions away from each other to increase the interior angle between the two link members 60 and 61. As a result, the distance in the Y-direction between the pivot pin 60*a* and the engaging pin 60*b* and the distance in the Y-direction between the pivot pin 61*a* and the engaging pin 61*b* become smaller than those before the change in shape of the Y-direction guide mechanism YM, so that the cover member 20 together with the circuit board 50 linearly moves downward relative to the stationary support plate 10.

Accordingly, camera shake can be corrected by varying the position of the CCD 3 secured to the base plate 25 in the X and Y directions in accordance with the movement of the circuit board 50 in the X and Y directions.

In the stage apparatus shown in FIGS. 10 and 11, the X-direction guide mechanism XM and the Y-direction guide mechanism YM are constructed out of a less number of elements, i.e., the two link members 60 and 61, and the following components for connecting each of the two link members 60 and 61 to the stationary support plate 10 and the cover member 20: the two pivot pins 62 and 63, the two engaging pins 60*b* and 61*b*, the two X-direction guide slots 23*a* and 24*a* (which are respectively formed on the support projections 23 and 24) and the two spur gears 60*a* and 61*a*. Consequently, the stage apparatus shown in FIGS. 10 and 11 is very simple in structure, and the manufacturing cost of the camera shake correction apparatus 5 can be reduced.

Figure 12:
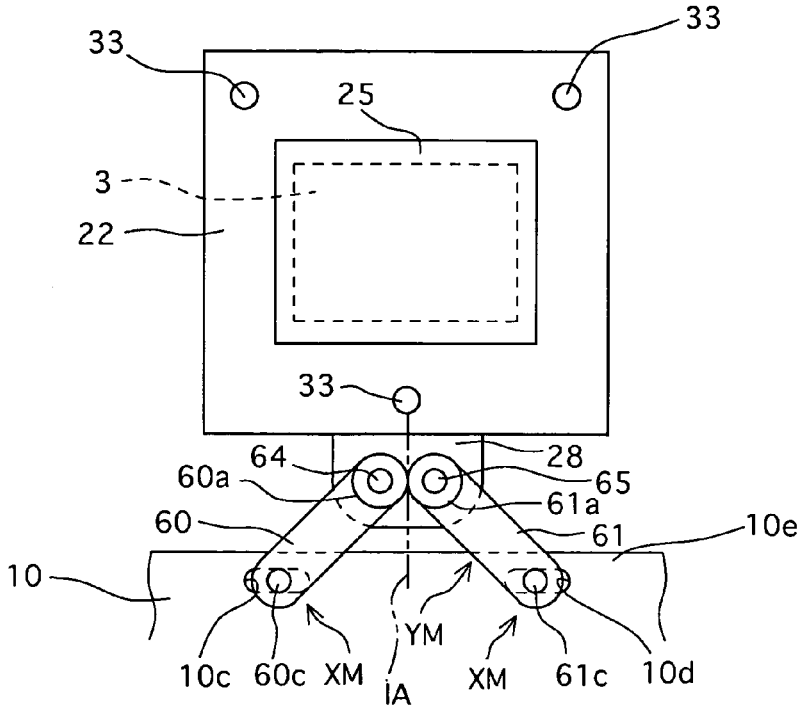
FIG. 12 is a rear elevational view of a modified embodiment of the guide mechanism provided in the second embodiment of the camera shake correction apparatus, wherein the electric circuit board and other members are not shown for clarity.

The guide mechanism provided in the second embodiment of the camera shake correction apparatus 5 shown in FIGS. 10 and 11 can be modified as shown in FIG. 12. In the modified embodiment of the guide mechanism shown in FIG. 12, the cover member 20 is provided on a bottom surface thereof with a support projection 28 which extends vertically downwards. The stationary support plate 10 is provided with a left X-direction guide slot 10*c* and a right X-direction guide slot 10*d* which are elongated in the X-direction on a straight line extending in the X-direction. The two link members 60 and 61 are provided, on front surfaces thereof in the vicinity of the lower ends of the two link members 60 and 61, with two engaging pins 60*c* and 61*c* which project forward to be engaged in the left X-direction guide slot 10*c* and the right X-direction guide slot 10*d*, respectively. The two link members 60 and 61 are provided at upper ends of the rear surfaces thereof with two spur gears 60*a* and 61*a*, respectively, which remain in mesh with each other. The upper end of the first link member 60 is pivoted, together with the spur gear 60*a*, about a pivot pin 64 which is fixed to the support projection 28 to extend in the optical axis direction, while the upper end of the second link member 61 is pivoted, together with the spur gear 60*a*, about a pivot pin 65 which is fixed to the support projection 28 to extend in the optical axis direction.

The X-direction guide slots 10*c* and 10*d* (and also the engaging pins 60*c* and 61*c*) are positioned on a straight line extending in the X-direction, while the pivot pins 64 and 65 are positioned on another straight line extending in the X-direction.

The pivot pins 64 and 65 and the spur gears 60*a* and 61*a* are elements of a link-member support mechanism.

The two link members 60 and 61, the two pivot pins 64 and 65, the two spur gears 60*a* and 61*a*, the two-X-direction guide slots 10*c* and 10*d* and the two engaging pins 60*c* and 61*c* are elements of a Y-direction guide mechanism YM. The two-X-direction guide slots 10*c* and 10*d* and the two engaging pins 60*c* and 61*c* are elements of an X-direction guide mechanism XM.

As can be understood from the above description, in the guide mechanism shown in FIG. 12, it is possible to guide the circuit board 50 in the X-Y direction while maintaining the symmetrical shape of the two link members 60 and 61 with respect to an imaginary axis IA (which extends in the Y-direction between the two pivot pins 64 and 65), and accordingly, the guide mechanism shown in FIG. 12 produces the same effect as the guide mechanism shown in FIGS. 10 and 11.

In the guide mechanism shown in FIGS. 10 and 11 which is provided in the second embodiment of the camera shake correction apparatus 5, the rotatable balls 31, the three compression coil springs 32 and the three contacting members 33, which serve as a support device for supporting the cover member 20 on the stationary support plate 10, can be omitted if the support projections 23 and 24, the link members 60 and 61, the two pivot pins 62 and 63 and the engaging pins 60*b*, 61*b* are made of material having a high strength.

Likewise, in the modified embodiment of the guide mechanism shown in FIG. 12, the rotatable balls 31, the three compression coil springs 32 and the three contacting members 33, which serve as a support device for supporting the cover member 20 on the stationary support plate 10, can be omitted if the support projection 28, the link members 60 and 61, the two pivot pins 64 and 65 and the engaging pins 60*c*, 61*c* are made of material having a high strength.

Figure 13:
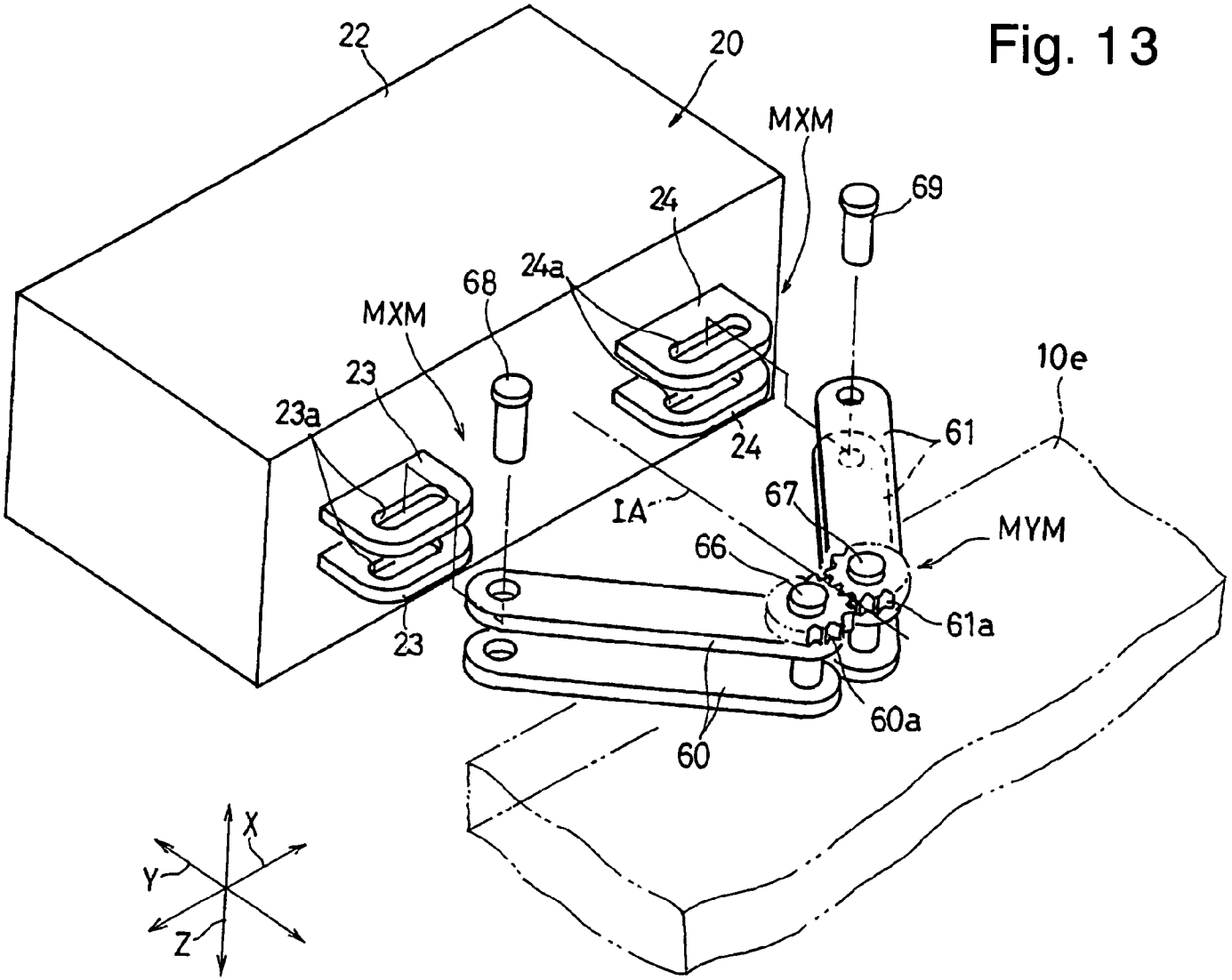
FIG. 13 is a view similar to that of FIG. 9 and illustrates another modified embodiment of the guide mechanism provided in the second embodiment of the camera shake correction apparatus, wherein the electric circuit board and other members are not shown for clarity.

FIG. 13 is a perspective view of another modified embodiment of the guide mechanism provided in the second embodiment of the camera shake correction apparatus. Similar to the double-layer guide mechanism shown in FIG. 9, this modified embodiment of the guide mechanism is provided with a double-layer guide mechanism consisting of an X-direction guide mechanism MXM and a Y-direction guide mechanism MYM. The double-layer Y-direction guide mechanism MYM is provided with two sets of the two link members 60 and 61, one set of which is superposed on the other set in the optical axis direction. Specifically, as shown in FIG. 13, the two sets of the two link members 60 and 61 are positioned so that one set of which is superposed on the other set in a Z-direction (fore-aft direction of the digital camera 1 shown by a double-headed arrow Z in FIG. 13; vertical direction as viewed in FIG. 13) orthogonal to both the X-direction and the Y-direction. The lower ends of the two first link members 60 are connected to each other by a pivot pin (connecting member) 66 which extends in the Z-direction, the lower ends of the two second link members 61 are connected to each other by a pivot pin (connecting member) 67 which extends in the Z-direction, the upper ends of the two first link members 60 are connected to each other by an engaging pin (connecting member) 68 extending in the Z-direction, and the upper ends of the two second link members 61 are connected to each other by an engaging pin (connecting member) 69 extending in the Z-direction. In this case, the lower ends of the two first link members 60 are positioned immediately behind the stepped portion 10*e* of the stationary support plate 10, while a front end of the pivot pin 66 is pivoted to the stepped portion 10*e* of the stationary support plate 10. Likewise, the lower ends of the two second link members 61 are positioned immediately behind the stepped portion 10*e* of the stationary support plate 10, while a front end of the pivot pin 67 is pivoted on the stepped portion 10*e* of the stationary support plate 10. In addition, the plate portion 22 is provided on a bottom surface thereof with two pairs of support projections (two left support projections and two right support projections) 23 and 24 which extend vertically downwards, two X-direction guide slots 23*a* and two X-direction guide slots 24*a* are formed on the two left support projections 23 and the two right support projections 24, respectively, and the engaging pins 68 and 69 are inserted into the two X-direction guide slots 23*a* and the two X-direction guide slots 24*a*, respectively.

The pivot pins 66 and 67 and the spur gear 60*a* and 61*a* are elements of a link-member support mechanism.

The two first link members 60, the two second link members 61, the spur gears 60*a* and 61*a*, the pivot pins 66 and 67, the engaging pins 68 and 69 and the X-direction guide slots 23*a* and 24*a* are elements of the double-layer Y-direction guide mechanism MYM.

The engaging pins 68 and 69, the two X-direction guide slots 23*a* and the two X-direction guide slots 24*a* are elements of the double-layer X-direction guide mechanism MXM.

Similar to the guide mechanism provided in the second embodiment of the camera shake correction apparatus 5, in the guide mechanism shown in FIG. 13, the two sets of link members 60 and 61 are driven while maintaining a symmetrical shape thereof with respect to an imaginary axis IA (which extends in the Y-direction between the pivot pins 66 and 67), and accordingly, the guide mechanism shown in FIG. 13 produces the same effect as the guide mechanism provided in the second embodiment of the camera shake correction apparatus.

Moreover, the strength of each of the double-layer Y-direction guide mechanism MYM and the double-layer X-direction guide mechanism MXM is increased by the above described structure of the guide mechanism in which one of the two sets of the two link members 60 and 61 is superposed on the other set of the two link members 60 and 61 in the Z-direction. Consequently, the rotatable balls 31, the three compression coil springs 32 and the three contacting members 33, which serve as a support device for supporting the cover member 20 on the stationary support plate 10, can be omitted.

It is possible for the two X-direction guide slots 23*a* and the two X-direction guide slots 24*a* to be formed on the upper ends of the two link members 60 and the upper ends of the two link members 61, respectively, and for the engaging pins 68 and 69 which are respectively engaged in the two X-direction guide slots 23*a* and the two X-direction guide slots 24*a* to be provided on the cover member 20.

It is possible for the double-layer guide mechanism to be replaced by a multi-layer guide mechanism which is provided with more than two sets of the two link members 60 and 61 which are superposed on one another in the Z-direction.

Figure 14:
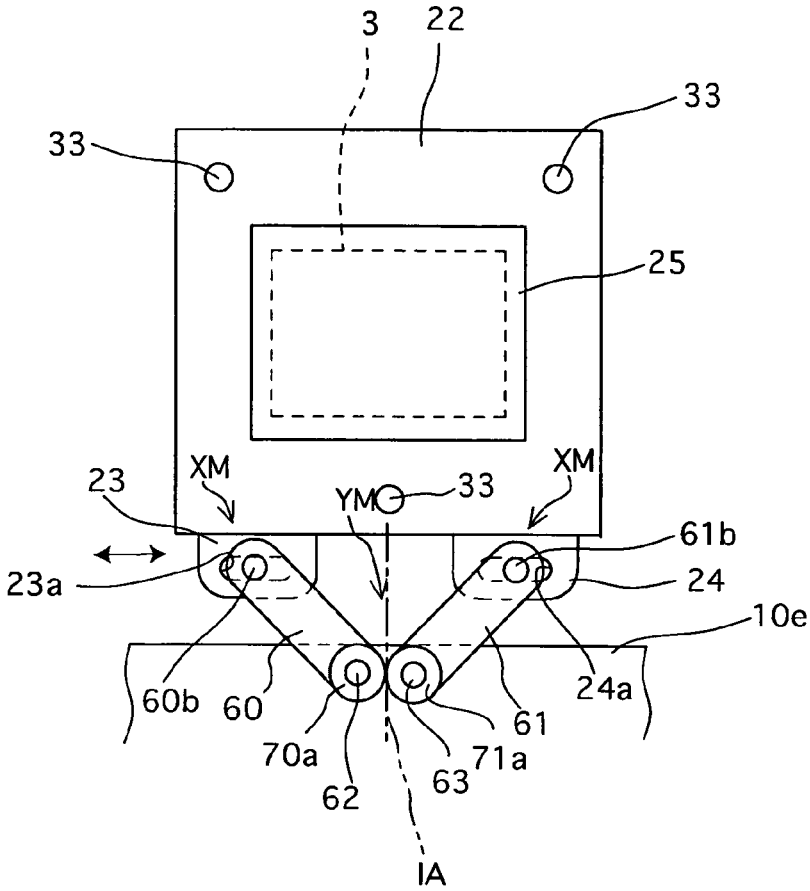
FIG. 14 is a rear elevational view of main components of a modification of the second embodiment, wherein the electric circuit board and other members are not shown for clarity.

It is possible for the two spur gears 60*a* and 61*a* in each of the above described three guide mechanisms shown in FIG. 10 through 13 to be replaced by two frictional engaging members 70*a* and 71*a* (shown in FIG. 14) which are made of material having a high frictional coefficient and which remain in contact with each other with no slippage occurring between the two frictional engaging members during rotation thereof.

Figure 15:
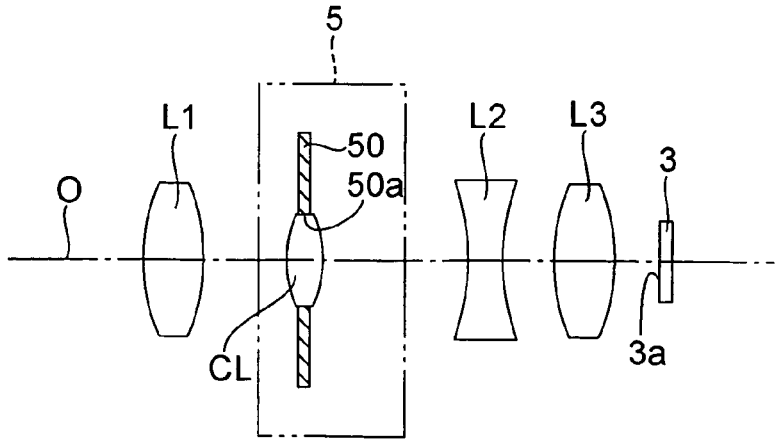
FIG. 15 is an axial cross sectional view of a portion of a modified embodiment of the camera shake correction apparatus according to the present invention, wherein a correction lens is provided.

Although the CCD 3 is secured to the circuit board 50 which is moved in the X and Y directions to compensate the camera shake in each of the above illustrated first and second embodiments of the camera shake correction apparatuses 5, it is possible to arrange the CCD 3, for example as shown in FIG. 15, behind the camera shake correction apparatus 5 and to form a circular mounting hole 50*a* in the circuit board 50. A correction lens CL can be fitted and secured to the mounting hole 50*a* and can be arranged between the lenses L1 and L2 as shown in FIG. 15 (or alternatively between the lenses L2 and L3). In this alternative, the correction lens CL is linearly moved in the X and Y directions to compensate camera shake. Furthermore, the camera shake correction apparatus 5 using the correction lens CL can be applied to a silver-halide film camera having no CCD 3.

Additionally, even if each of the X-direction line LX and the Y-direction line LY is not precisely located on the center of gravity G of the aforementioned movable block that includes the circuit board 50 and other members, but is located near the center of gravity G in the fore-aft direction of the digital camera 1, the forces generated in the X-direction drive coil CX and the Y-direction drive coil CY can still be effectively transmitted to the circuit board 50.

In addition to the foregoing, although the yoke members YX and YY (and the magnets MX and MY) are provided on the stationary support plate 10 while the X-direction drive coil CX and the Y-direction drive coil CY are provided on the circuit board 50 in each of the first and second embodiments of the camera shake correction apparatus 5, it is possible to provide the X-direction drive coil CX and the Y-direction drive coil CY on the stationary support plate 10 and to provide the yoke members YX and YY (and the magnets MX and MY) on the circuit board 50.

Moreover, the electromagnetic actuator consisting of the X-direction drive coil CX, the Y-direction drive coil CY, the magnets MX and MY and the yoke members YX and YY can be replaced by any other type of actuator, e.g., a motor-driven actuator or an actuator using piezoelectric elements for moving the circuit board 50 in the X and Y direction.

Although the above discussion has been addressed to several embodiments of stage apparatuses applied to the camera shake correction apparatus 5, the application of the stage apparatus according to the present invention is not limited thereto. The invention can be variously applied to an apparatus in which, e.g., a stage plate in the form of a circuit board is moved in the X and Y directions parallel with the circuit board.

Obvious changes may be made in the specific embodiments of the present invention described herein, such modifications being within the spirit and scope of the invention claimed. It is indicated that all matter contained herein is illustrative and does not limit the scope of the present invention.

What is claimed is:

1. A stage apparatus in which a movable stage is guided in first and second directions orthogonal to each other on a stationary member, said stage apparatus comprising:

a pair of first elongated holes formed on one of said movable stage and said stationary member, said pair of first elongated holes being aligned on a straight line extending in said first direction;

a pair of link members having engaging pins at first ends thereof which are engaged in said pair of first elongated holes to be relatively movable therein along said first direction, respectively, one of second ends of said pair of link members being pivoted at the other of said movable stage and said stationary member, and the other of said second ends of said pair of link members being supported by said other of said movable stage and said stationary member; and a link-member support mechanism for moving said movable stage in said second direction by moving said pair of link members while maintaining a symmetrical shape thereof with respect to an imaginary axis which extends in said second direction.

2. The stage apparatus according to claim 1, wherein central portions of said pair of link members are pivotally mounted to each other so that said pair of link members form a shape of a letter X.

3. The stage apparatus according to claim 2, wherein said link-member support mechanism comprises:

a pivot, fixed to said stationary member, about which said one of said second ends of said pair of link members is pivoted;

an angle-varying elongated hole formed on said stationary member elongated in said first direction; and a support pin fixed to said other of said second ends of said pair of link members to be slidably engaged in said angle-varying elongated hole.

4. The stage apparatus according to claim 1, wherein said pair of link members are positioned so as to not to overlap each other in a third direction orthogonal to both said first direction and said second direction.

5. The stage apparatus according to claim 4, wherein said second ends of said pair of link members are pivoted on said stationary member.

6. The stage apparatus according to claim 5, wherein said second ends of said pair of link members comprise two gears, respectively, which remain in mesh with each other so that said pair of link members pivot about axes of said two gears in opposite rotational directions, respectively, in a symmetrical manner with respect to said imaginary axis.

7. The stage apparatus according to claim 5, wherein said second ends of said pair of link members comprise two frictional engaging members, respectively, which remain engaged with each other so that said pair of link members pivot about axes of said frictional engaging members in opposite rotational directions, respectively, in a symmetrical manner with respect to said imaginary axis.

8. The stage apparatus according to claim 1, further comprising:

a second-direction actuator which moves said movable stage in said second direction relative to said stationary member while expanding and contracting said pair of link members in said second direction; and a first-direction actuator which moves said movable stage in said first direction relative to said pair of link members.

9. The stage apparatus according to claim 4, wherein said pair of link members are positioned to form a shape of a letter V.

10. The stage apparatus according to claim 8, wherein each of said first-direction actuator and said second-direction actuator comprises an electromagnetic actuator.

11. The stage apparatus according to claim 1, further comprising a support device for continuously supporting and holding a plate portion of said movable stage in a position parallel to said stationary member.

12. The stage apparatus according to claim 11, wherein said support device comprises a plurality of springs.

13. The stage apparatus according to claim 3, wherein said link-member support mechanism comprises a connecting pin, said central portions of said pair of link members being pivoted about said connecting pin.

14. The stage apparatus according to claim 13, wherein said imaginary axis passes through said connecting pin.

15. The stage apparatus according to claim 2, wherein said imaginary axis passes through a pivot about which said central portions of said pair of link members are pivoted.

16. The stage apparatus according to claim 1, wherein said stationary member is formed as a stationary support plate positioned perpendicular to an optical axis of said photographing optical system.

17. A stage apparatus in which a movable stage is guided in first and second directions orthogonal to each other on a stationary member, said stage apparatus comprising:

two pairs of first elongated holes formed on one of said movable stage and said stationary member, each pair of said two pairs of first elongated holes being aligned on a straight line extending in said first direction, wherein one pair opposes the other pair of said two pairs of first elongated holes in a third direction orthogonal to said first and second directions so as to define first opposed elongated holes and second opposed elongated holes;

two pairs of link members, one pair of which is superimposed on the other pair thereof in said third direction to be parallel to each other so as to define first and second opposed link members which are opposed in said third direction, said first and second opposed link members having first and second engaging pins at first ends thereof which are engaged in corresponding said first and second opposed elongated holes to be relatively movable therein along said first direction, respectively, wherein a second end of said first opposed link members is pivoted on the other of said movable stage and said stationary member, and a second end of said second opposed link members is supported by said other of said movable stage and said stationary member;

a link-member support mechanism for moving said movable stage in said second direction by moving said two pairs of link members while maintaining a symmetrical shape thereof with respect to an imaginary axis which extends in said second direction.

18. The stage apparatus according to claim 17, further comprising:

a second-direction actuator which moves said movable stage in said second direction relative to said stationary member while expanding and contracting said two pairs of link members in said second direction; and a first-direction actuator which moves said movable stage in said first direction relative to said two pairs of link members.

19. The stage apparatus according to claim 18, wherein said stage apparatus is incorporated in a camera, wherein said camera comprises:

an image pick-up device which is located on an image plane of a photographing optical system of said camera;

a camera shake detection sensor which detects camera shake of said camera; and a controller for driving said first-direction actuator and said second-direction actuator in accordance with said camera shake detected by said camera shake detection sensor to stabilize an object image which is formed on said image pick-up device through said photographing optical system.

20. The stage apparatus according to claim 18, wherein said stage apparatus is incorporated in a camera, wherein said camera comprises:

a correction lens fixed to said movable stage in front of an image plane of a photographing optical system of said camera to be provided on an optical axis of said photographing optical system;

a camera shake detection sensor which detects camera shake of said camera; and a controller for driving said first-direction actuator and said second-direction actuator in accordance with said camera shake detected by said camera shake detection sensor to stabilize an object image which is formed on said image pick-up device through said photographing optical system and said correction lens.

21. The stage apparatus according to claim 17, wherein said stationary member is formed as a stationary support plate positioned perpendicular to an optical axis of said photographing optical system.

22. The stage apparatus according to claim 17, wherein central portions of said two pairs of link members are pivotally mounted to each other so that said two pairs of link members form a shape of a letter X.

23. The stage apparatus according to claim 22, wherein said link-member support mechanism comprises:

a pivot, fixed to said stationary member, about which said second end said first opposed link members is pivoted;

an angle-varying elongated hole formed on said stationary member elongated in said first direction; and a support pin fixed to said second end of said second opposed link members to be slidably engaged in said angle-varying elongated hole.

24. The stage apparatus according to claim 17, wherein said first and second opposed link members are positioned so that said first opposed link members do not overlap said second opposed link members in said third direction, and said second opposed link members do not overlap said first opposed link members in said third direction.

25. The stage apparatus according to claim 24, wherein said second ends of said first and second opposed link members are pivoted on said stationary member.

26. The stage apparatus according to claim 25, wherein said second ends of said first and second opposed link members comprise two gears, respectively, which remain in mesh with each other so that said two pairs of link members pivot about axes of said two gears in opposite rotational directions, respectively, in a symmetrical manner with respect to said imaginary axis.

27. The stage apparatus according to claim 25, wherein said second ends of said first and second opposed link members comprise two frictional engaging members, respectively, which remain engaged with each other so that said two pairs of link members pivot about axes of said frictional engaging members in opposite rotational directions, respectively, in a symmetrical manner with respect to said imaginary axis.

* * * * *